US006070568A

United States Patent [19]

Dibble et al.

[11] Patent Number: 6,070,568

[45] **Date of Patent: *Jun. 6, 2000**

[54] IGNITION CIRCUITS

[76] Inventors: Jonathan Redecen Dibble, 30 Cottage Gardens, Great Billing, Northhampton NN3 9YW, United Kingdom; Andrew Desmond Nutt, "Greenacres", 47 Easton Way, Grendon, Northhampton NN7 2JQ, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/993,907

[22] Filed: Dec. 18, 1997

[30] Foreign Application Priority Data

Oct. 29, 1997 [GB] United Kingdom ..... 9722858

[51] Int. Cl.[7] ..... F02P 3/04

[52] U.S. Cl. ..... 123/653; 123/655

[58] Field of Search ..... 123/620, 653, 123/654, 655, 656, 633

[56] References Cited

U.S. PATENT DOCUMENTS

| | | | |
|---|---|---|---|
| 3,760,782 | 9/1973 | Meyer | 123/604 |
| 3,926,557 | 12/1975 | Callies et al. | 123/606 |
| 4,083,347 | 4/1978 | Grather et al. | 123/620 |
| 4,138,710 | 2/1979 | Tsukuru | 123/655 X |
| 4,203,403 | 5/1980 | Fujii et al. | 123/656 |
| 4,361,129 | 11/1982 | Sugie et al. | 123/655 X |
| 4,411,247 | 10/1983 | Kunita et al. | 123/655 |
| 4,463,744 | 8/1984 | Tanaka et al. | 123/653 X |
| 4,596,222 | 6/1986 | Ortiz | 123/536 |
| 5,044,348 | 9/1991 | Ookawa | 123/637 |
| 5,044,349 | 9/1991 | Benedikt et al. | 123/655 |
| 5,168,858 | 12/1992 | Mong | 123/620 |
| 5,379,745 | 1/1995 | Vogel et al. | 123/655 |
| 5,548,472 | 8/1996 | Balland | 361/253 |
| 5,634,453 | 6/1997 | Taruya et al. | 123/645 |
| 5,762,052 | 6/1998 | Minkov et al. | 123/607 |

FOREIGN PATENT DOCUMENTS

| | | | |
|---|---|---|---|
| 63-94080 | 4/1988 | Japan | 123/655 |
| 1527872 | 10/1978 | United Kingdom . | |
| 1571884 | 7/1980 | United Kingdom . | |
| 90/15242 | 12/1990 | WIPO . | |
| 92/08048 | 5/1992 | WIPO . | |
| 95/09303 | 4/1995 | WIPO . | |

*Primary Examiner*—Tony M. Argenbright

[57] ABSTRACT

The invention describes a novel circuit to be used in spark-ignition combustion engines. An ignition circuit according to the invention extends the voltage decay time following the initial generation of a spark across the spark plug gap. In addition, it reduces the oscillation of the voltage following any secondary negative spike. Use of the circuit increases combustion efficiency and reduces wear and tear on the spark plugs. This purpose is achieved by including a diode and a capacitor in the spark circuit; alternately, the diode may act as a capacitor when reverse biased.

9 Claims, 9 Drawing Sheets

GB60 EMISSION RESULTS BASED ON
BEFORE AND AFTER FITTING

| CAVILIER 1800SRI | BEFORE GB60 | AFTER GB60 |
|---|---|---|
| CO2 | 10.05% | 0.25% |
| | % CHANGE | -97.5% |

| CAVILIER 1800SRI | BEFORE GB60 | AFTER GB60 |
|---|---|---|
| HC(PPM) | 560 | 35 |
| | % CHANGE | -93.8% |

| CAVILIER 1800SRI | BEFORE GB60 | AFTER GB60 |
|---|---|---|
| CO | 1.27% | 0.03% |
| | % CHANGE | -97.8% |

| CAVILIER 1800SRI | BEFORE GB60 | AFTER GB60 |
|---|---|---|
| O2 | 4.80% | 20.90% |
| | % CHANGE | 335.4% |

GB60 EMISSION RESULTS BASED ON
BEFORE AND AFTER FITTING

| ROVER 827i | BEFORE GB60 | AFTER GB60 |
|---|---|---|
| CO | 0.01% | 0.00% |
| % CHANGE | | -100% |

| ROVER 827i | BEFORE GB60 | AFTER GB60 |
|---|---|---|
| HC(PPM) | 38 | 9 |
| % CHANGE | | -76.3% |

| ROVER 827i | BEFORE GB60 | AFTER GB60 |
|---|---|---|
| CO2 | 15.16% | 15.30% |
| % CHANGE | | 0.9% |

| ROVER 827i | BEFORE GB60 | AFTER GB60 |
|---|---|---|
| O2 | 0.00% | 0.00% |
| % CHANGE | | 0.0% |

IGNITION CIRCUITS

The present invention relates to ignition circuits for use in spark-ignition combustion engines.

The operation of internal combustion engines is known to be inefficient in various ways, both from the standpoint of fuel combustion and wear on the engine parts. The improvement of the operation of combustion engines in order to use fuel more efficiently and protect the environment is the subject of dedicated research and development all over the world.

Some efforts have concentrated on the ignition circuit itself, and in particular the shape of the spark. In a conventional ignition circuit the current versus time relationship begins with a sharp increase in current when the spark first occurs, followed by a period of lower current flow before voltage across the spark gap decays.

In WO-92/08048, it is postulated that the spark itself should be prolonged in order to achieve combustion, the period of lower current flow following the initial discharge being described as relatively ineffective. It is suggested that a capacitor positioned in the ignition circuit will be effective to maintain the sparks for longer and improve the combustion. A diode is also positioned in series with the capacitor. In fact, commonly available diodes and capacitors are not suitable to withstand the high temperatures and voltages present in combustion engines and until the present invention it is believed that no such components were available.

WO-94/17302, by the same inventor, suggests the use of relatively high value capacitors to achieve the desired effect.

This invention is based on the realisation that it is the low current low voltage period following the initial discharge, previously described as ineffective, which is essential for maintaining combustion.

According to the present invention, it is not the initial high voltage, high current spark which is prolonged, but the subsequent lower voltage lower current period sometimes referred to as the "back porch" of the spark characteristic.

The present invention provides a spark ignition circuit comprising a source of high voltage and a spark gap including a diode and a capacitor connected in parallel between the voltage source and the spark gap.

The diode may be arranged such that when an arc is deliberately induced across the spark gap, the diode conducts the arc current. In an effect to be described in more detail below, the diode/capacitor combination reduces opposite polarity voltage spikes following an initial discharge and the capacitor serves to maintain a low voltage across the spark plug terminals for a longer duration than was previously achievable.

Since a capacitor/diode combination can be installed in any existing engine, the invention also encompasses the use of a capacitor and a diode in parallel in an ignition circuit between the high voltage source and the spark gap.

Certain types of diode have an inherent junction capacitance such than when reverse biassed, they are equivalent to an open circuit and a capacitor in parallel. Therefore, another aspect of the invention provides a spark ignition circuit comprising a high voltage source and a spark gap and a diode between the voltage source and the spark gap, the diode having an inherent capacitance such that it acts as a capacitor when reverse biassed.

One of the most important effects of the diode seems to be its ability to "shorten" any opposite polarity voltage spikes following an initial discharge so that they do not interrupt the combustion as presently seems to occur with conventional internal combustion engines. Thus the diode is preferably a fast acting diode with a short reverse recovery time. The presently preferred diode has a reverse recovery time of typically 200 ns when switched from 100 mA at a rate of −200 mA/$\mu$s under a reverse voltage of 100 volts or more. A reverse recovery time of the order of 200 ns is therefore desirable.

In contrast to the arrangements disclosed in WO-94/117302, a relatively small capacitance, or junction capacitance, is desirable, typically no more than 1 pF. The presently preferred diode has a junction capacitance of no more than 1 pF, preferably 0.1–1 pF. The appropriate value may depend on the applied voltage.

The diode should be able to withstand the very high voltages present in ignition circuits. Preferably the diode can withstand a reverse breakdown voltage of 24,000 volts or more, and can preferably withstand forward voltages of the same order. In the preferred embodiment of the invention the diode can withstand forward and reverse voltages of between 24,000 and 90,000 volts.

The voltage source may be a pulse transformer or coil.

An embodiment of the invention will now be described by way of example only and with reference to the accompanying drawings in which.

Figure 1:
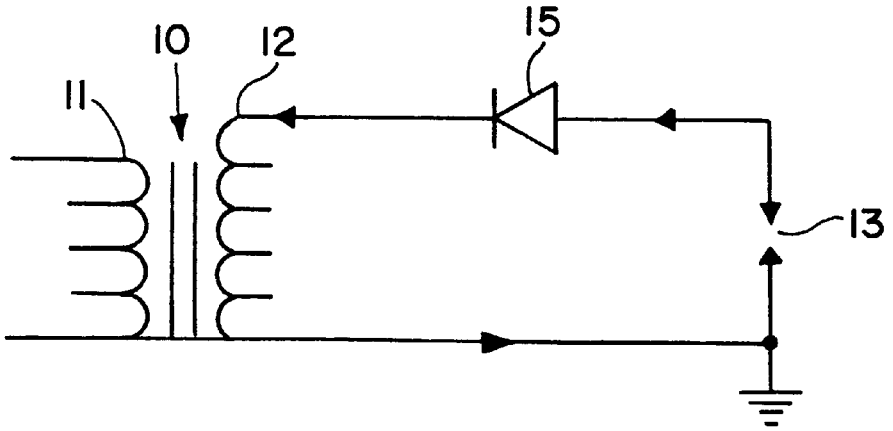
FIG. 1 shows a typical ignition circuit with an ultra fast soft recovery diode positioned between the spark plug terminals and the transformer.
Figure 2:
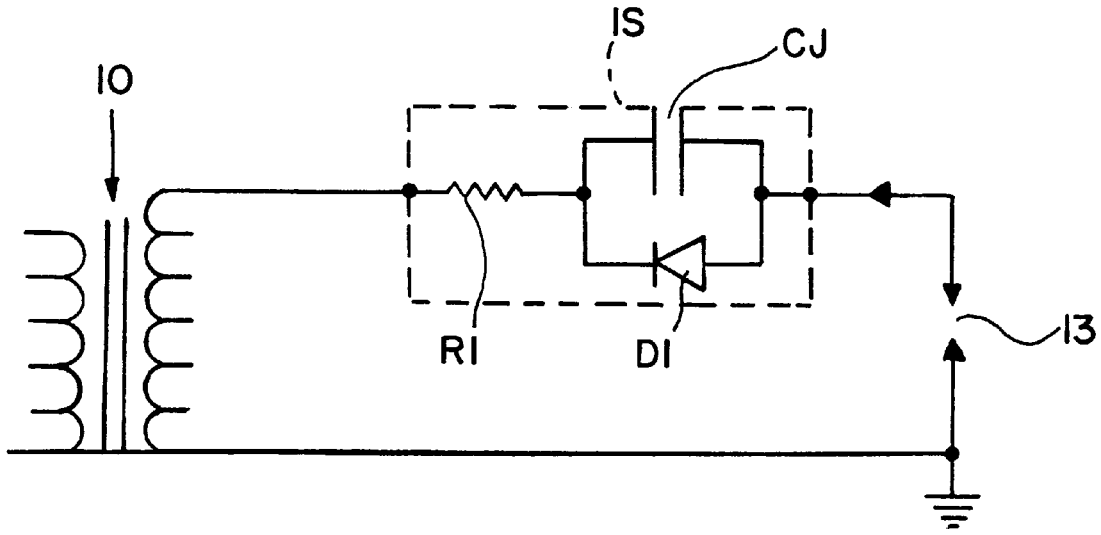
FIG. 2 is a circuit diagram similar to FIG. 1 showing the equivalent circuit of the diode.

The operation of spark ignition systems is well known in the art and will not be described in detail herein. FIGS. 1 and 2 show the usual pulse transformer 10 whose primary winding 11 is connected to a pulsed current source (not shown) including a battery. The transformer secondary winding 12 is connected to a spark plug 13. (Usually the connection is intermittent, and is governed by a distributor, omitted from FIGS. 1 and 2 for the sake of clarity.) A diode 15 is connected between the transformer secondary winding and the spark plug 13.

Figure 3:
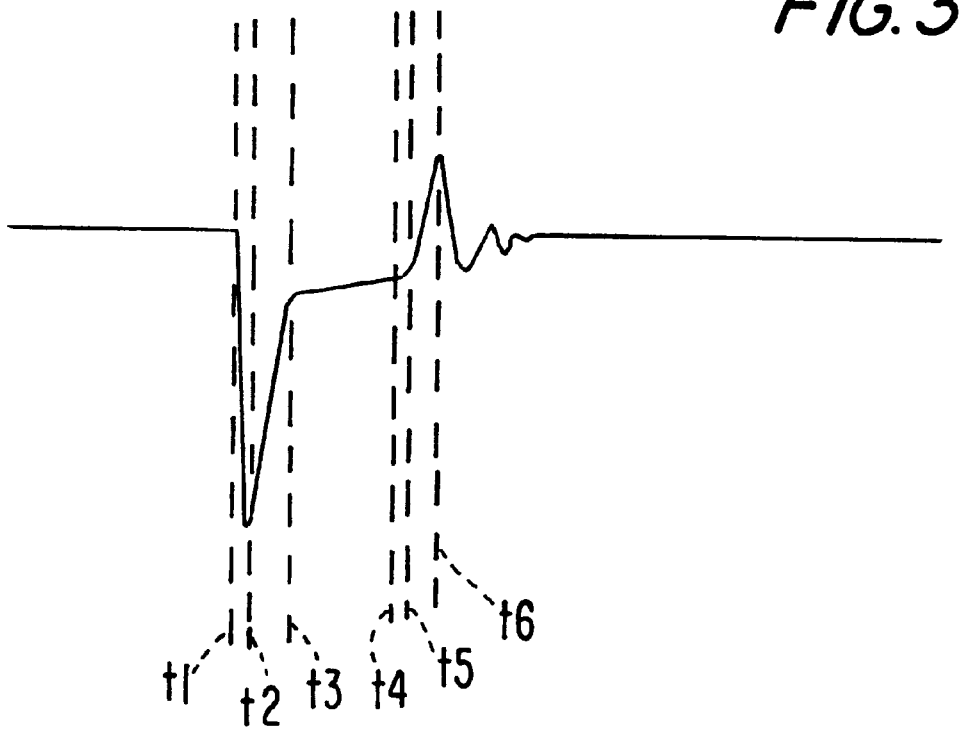
FIG. 3 is a diagram showing the variation of voltage with time during a typical ignition cycle when no diode is present in the ignition circuit.

In order to explain the operation of a spark ignition circuit according to the invention, the stages in conventional spark ignition will first be briefly explained with reference to FIG. 3. FIG. 3 shows the voltage characteristics of a conventional spark ignition circuit, similar to that of FIG. 1 but omitting the diode 15.

Current is supplied to the transformer primary winding 11 for a predetermined period (the dwell period) which ends at time $t_1$. The current sets up a magnetic field and as soon as the current supply is switched off the magnetic field decays inducing a voltage in the primary and secondary coil windings. The voltage induced in the secondary winding 12 is routed to the spark plug (via the distributor). The voltage, which is negative, increases in magnitude rapidly until an arc is created across the spark plug gap at time $t_2$. Current then flows and the voltage decays, first rapidly and then more slowly, during time $t_3$ to $t_4$. The current sets up a reverse polarity magnetic field in the transformer secondary winding 12. The voltage eventually decays to zero at time $t_5$, at which time current ceases to flow and the reverse effect occurs, with a smaller opposite polarity voltage spike occurring at time $t_6$. The voltage decays following a damped sinusoidal waveform until the dwell period recommences and the cycle is repeated.

The time $t_3$ to $t_4$, sometimes referred to as the "back porch" has been found to be particularly important for maintaining combustion in the cylinders and ensuring maximum use of fuel, and hence efficiency. Any additional voltage spikes after the back porch time has ended are unwanted and in fact cause wear on the spark plugs.

Figure 4:
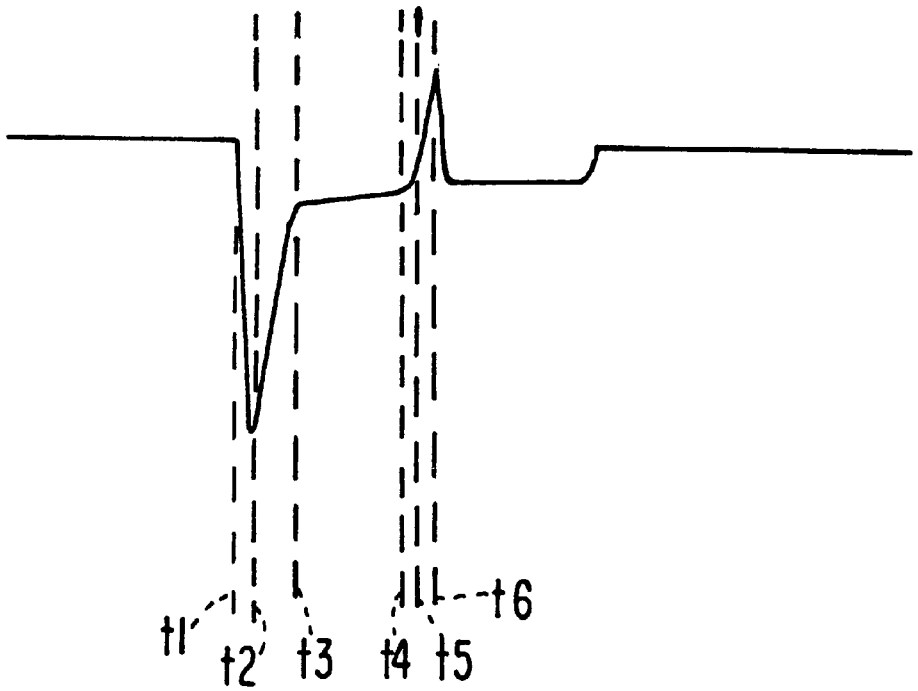
FIG. 4 is a diagram showing the variation of voltage with time using the circuit of FIG. 1.

The operation of the circuit of the present invention will now be described with reference to FIGS. 2 and 4. From time $t_1$ to $t_6$, the voltage across the spark plug varies in the same manner as in a conventional spark ignition circuit. From $t_1$ to $t_4$, the diode 15 is forward biassed and current flows in the direction of the arrows in FIG. 1.

The particular diode used in the circuit is equivalent to the circuit shown in dotted lines in FIG. 2, namely a diode D1 having a simple one-way flow path, in parallel with a capacitance, known as the junction capacitance, CJ, and in series with a resistance R1.

After time $t_6$, the following effect is believed to occur:

When a reverse polarity voltage spike occurs at time $t_6$, the diode D1 is reverse biassed and the junction capacitor CJ begins to charge. Due to the reverse recovery characteristics of the diode, a small reverse current flows causing the positive voltage spike at $t_6$ to decay more quickly than if the diode was not present. The negative voltage present after time $t_6$ is the voltage accumulated across the capacitor CJ which decays according to the time constant of the capacitor CJ. With a suitable choice of diode the negative voltage after time $t_6$ can be approximately equal to the voltage present during time $t_3$ to $t_4$.

The use of a diode which acts as a capacitor when reverse biassed has been found to significantly improve the fuel combustion in internal combustion engines. It is believed that the positive voltage spike is so short and sharp that it is imperceptible and the effect of the diode is simply to extend the "back porch" of the voltage characteristic. The continuing voltage which is present after the initial spark is known to be important for maintaining combustion. Also, more energy is present due to the concentration of the normally alternating current being concentrated into a longer time due to the extension of the back porch.

The effects described above have been achieved using as the diode 15 a high voltage fast soft-recovery diode available from Philips' semiconductors. Types BY714 and BY8424 have been found to be suitable although BY8424 is preferred. These diodes are designed for use in television circuits and diodes of this type have apparently not been used in ignition circuits.

Figure 5:
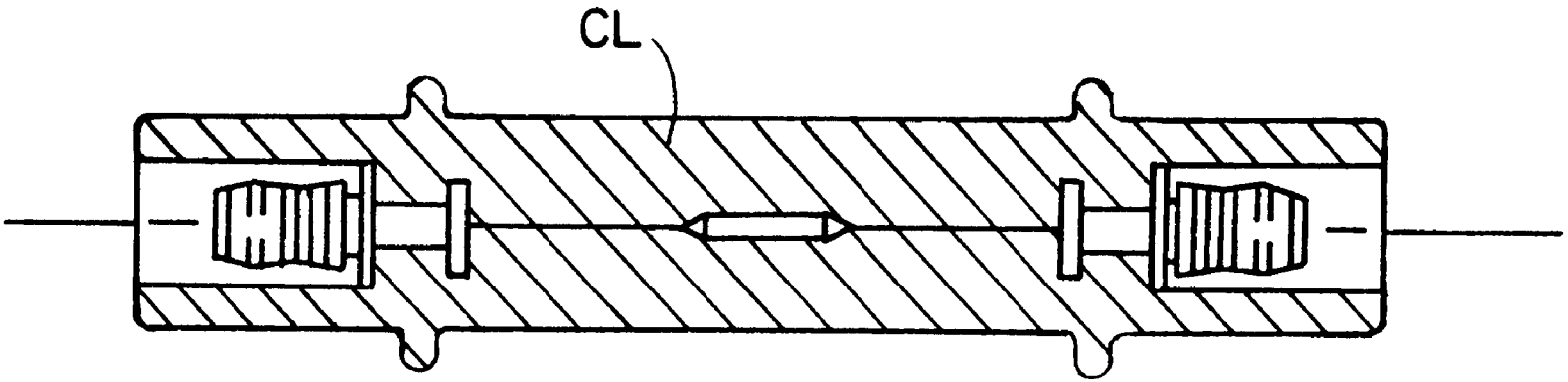
FIG. 5 is a drawing on a scale 1:1 showing a suitable diode potted and provided with suitable connectors for use in an internal combustion engine.
Figure 6:
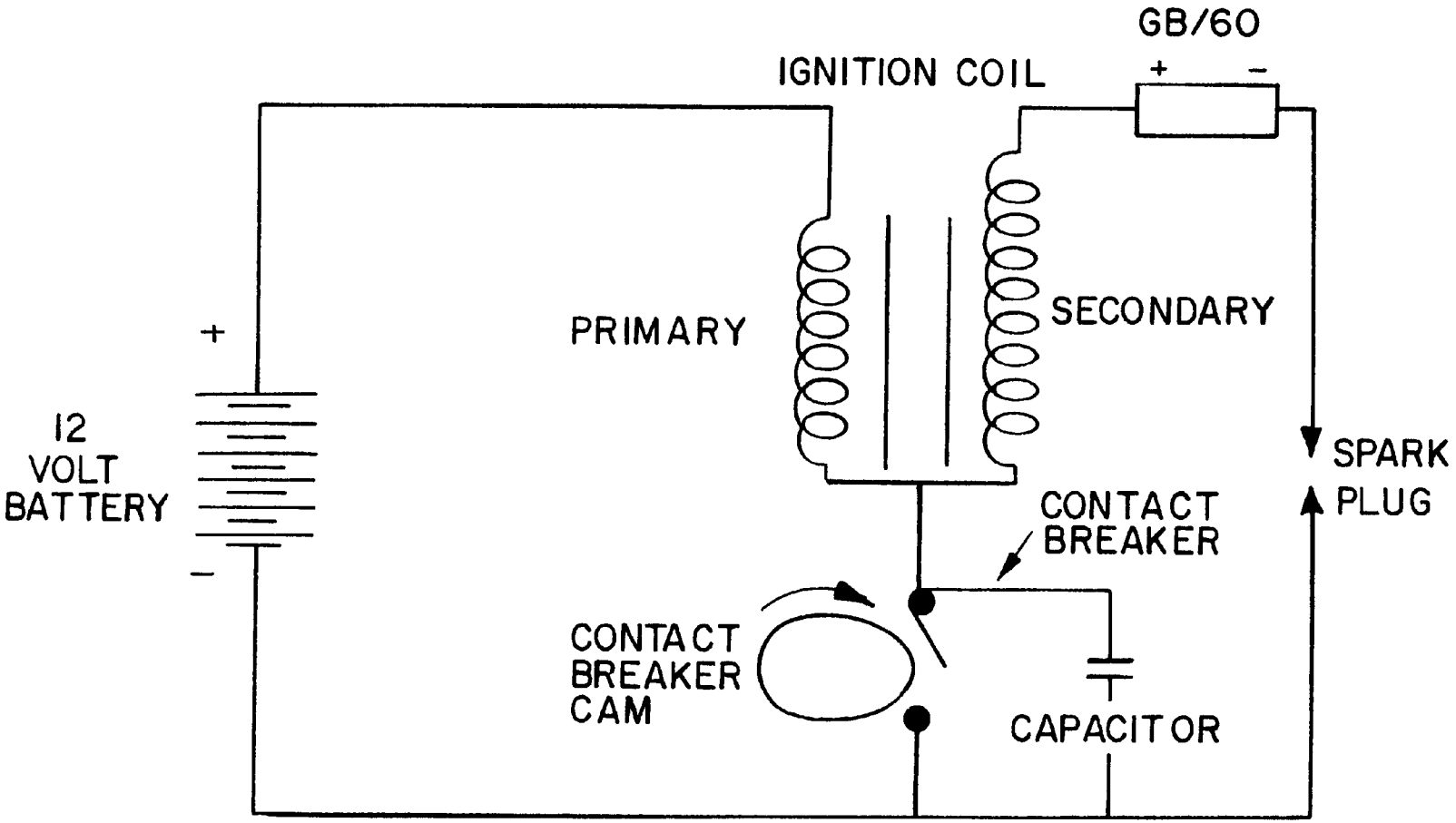
FIG. 6 is a schematic diagram of a typical coil and battery ignition circuit, according to the invention.
Figure 7:
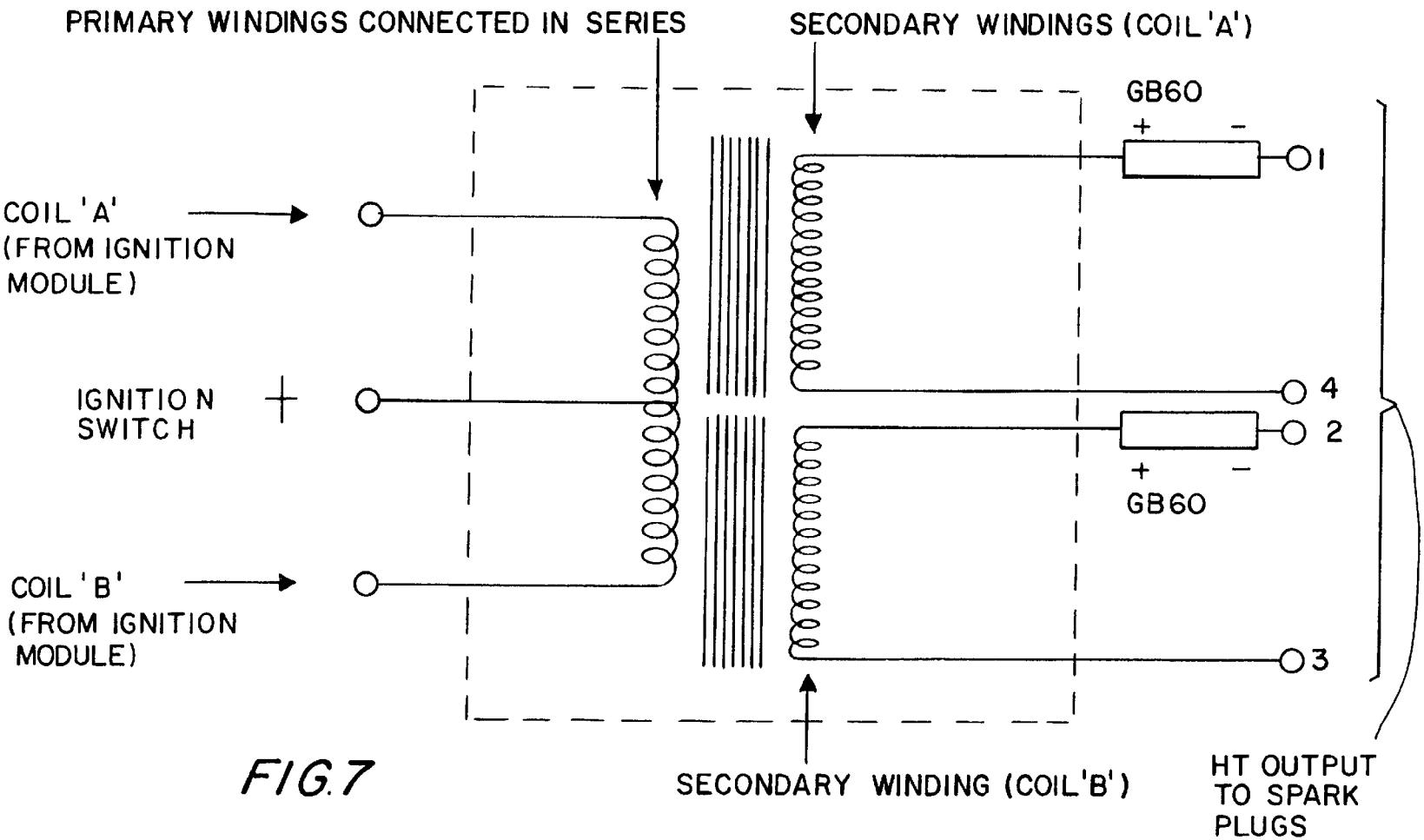
FIG. 7 is a schematic diagram of a DIS ignition circuit according to the invention.
Figure 8:
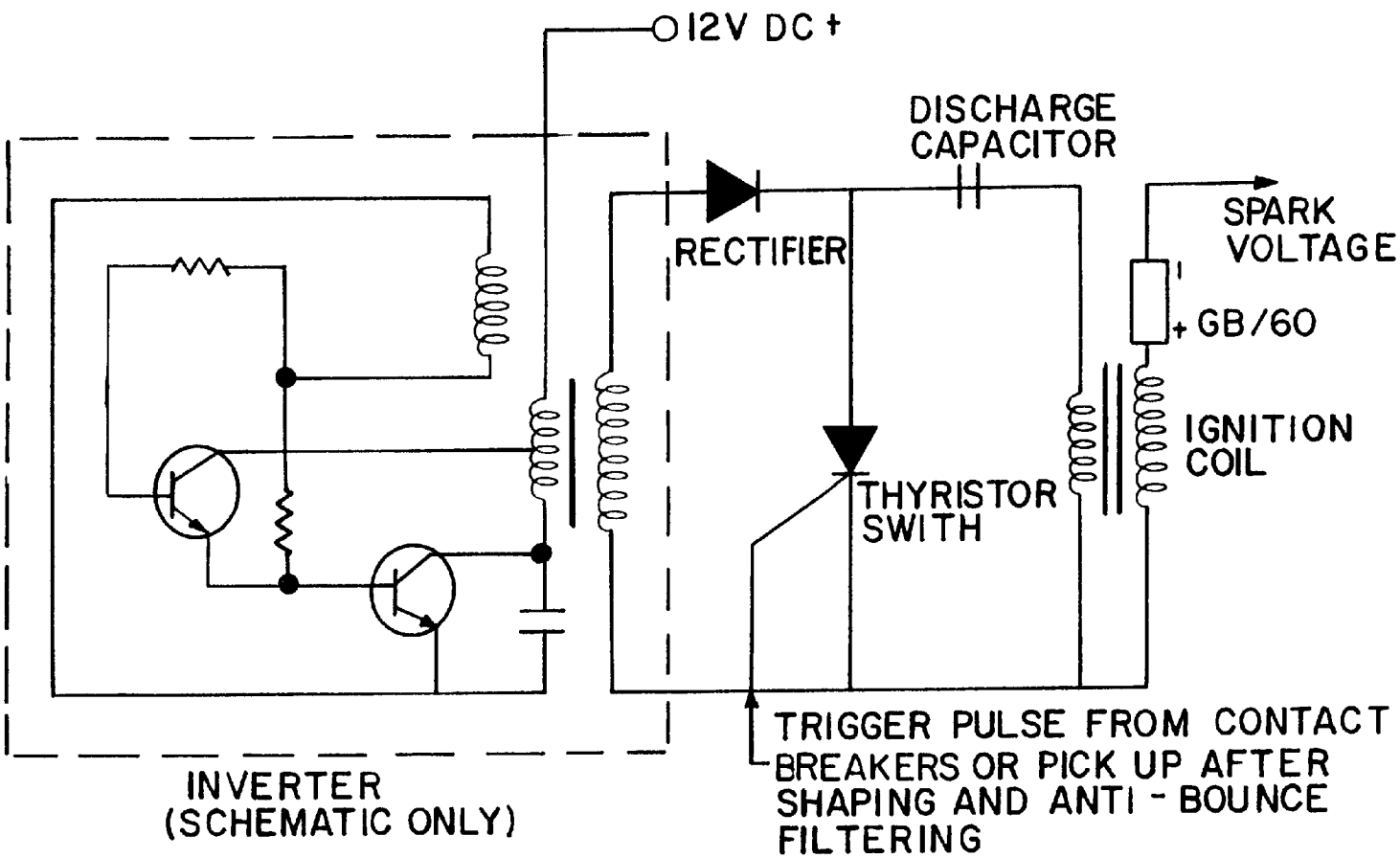
FIG. 8 is a schematic diagram of a CDI inverter ignition system according to the invention.
Figure 9:
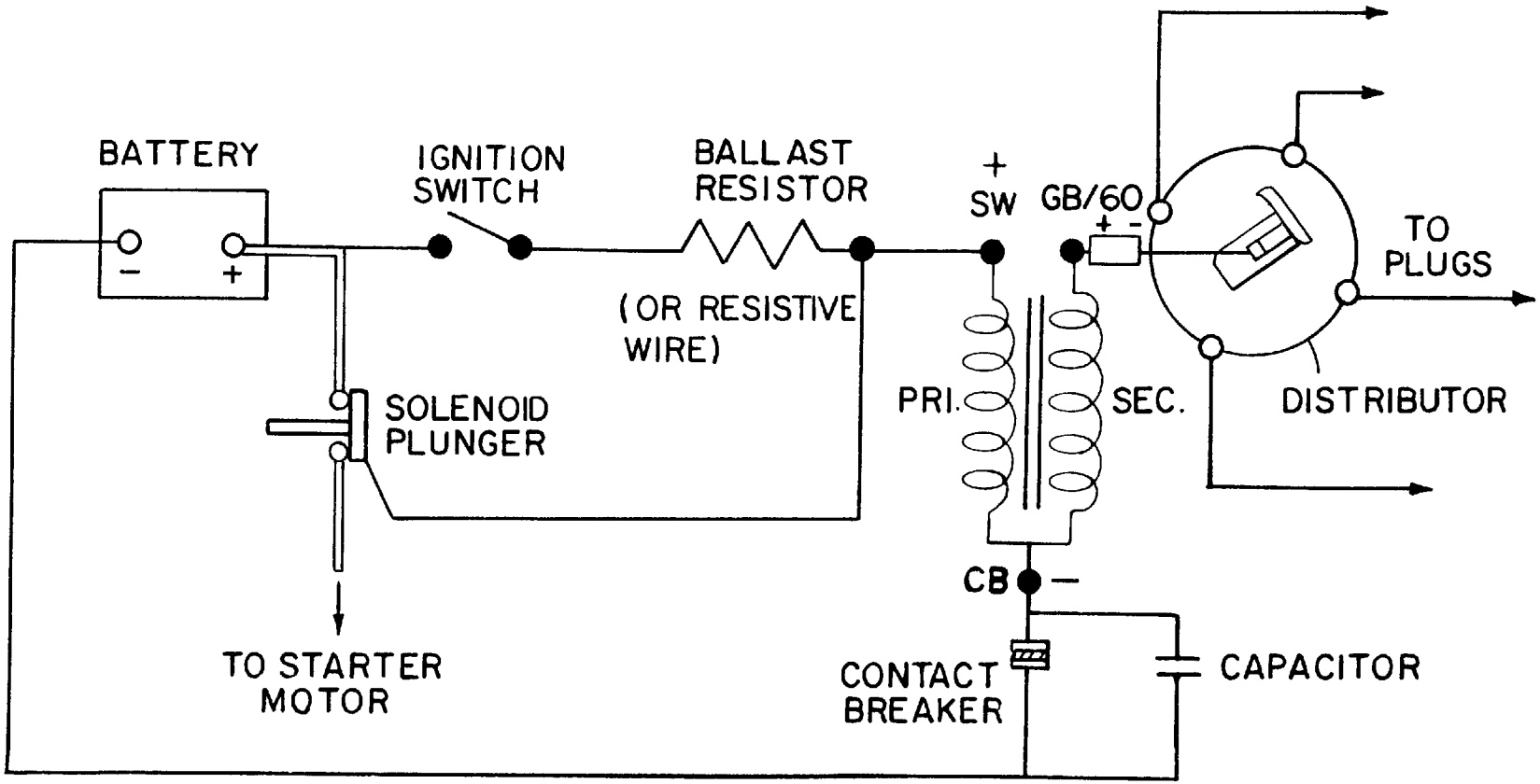
FIG. 9 is a schematic diagram of a ballasted ignition circuit according to the invention.

The diode is potted in a suitable dielectric potting compound to form a cylinder 17 of approximately 1.5 cm diameter and 5 cm long as shown in cross section in FIG. 5. Suitable terminals 19 are added to the cylinder 17. Simply placing the diode 15 in circuit with no potting compound or significantly less compound would result in sparks being produced across the diode. The potting compound must obviously be suitable to withstand the high temperatures in internal combustion engines. Specifically, for use in cars it must be a "car grade" material meting standard I EC 250. One suitable material is "Formulation 600" Epoxy Synthetic Polymer although other equally suitable materials are available in the electronics industry. The finished unit shown in FIG. 5 has no mechanical parts such as screws or nuts and bolts. The ends are preferably nickel chromium (as used in conventional spark plug ends). The unit is completely sealed with no moving parts, and has an electric strength of 140 kV/cm. In the illustration of FIG. 5, the cylinder has a reduced cross-section central barrel allowing faster cooling during operation and a reduced weight loading for the king lead.

The diode can be installed in any existing ignition circuit with no other modifications being required. Alternatively it can be installed in new ignition circuits. The diode can be installed in any location in the circuit from inside the coil to inside the spark plug.

FIGS. 6 to 9 show a few examples of ignition circuits in which the unit of FIG. 5, designated GB60 is installed. In all cases the unit is installed between the ignition coil secondary winding and the spark gap.

The use of the diode has been found to achieve virtually complete combustion of fuel in vehicles equipped with catalytic converters (zero CO and HC). The following two sheets show, by way of example, the results of tests on two vehicle engines.

Figure 10:
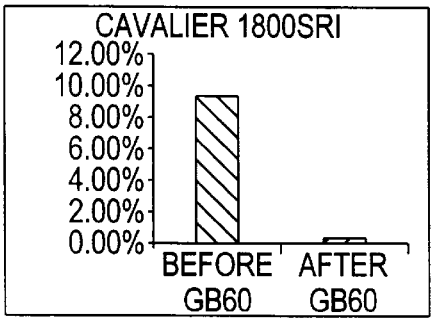
FIGS. 10 and 11 show test results from use of the invention.
Figure 10:
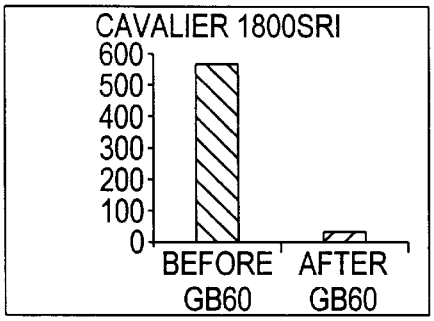
Figure 10:
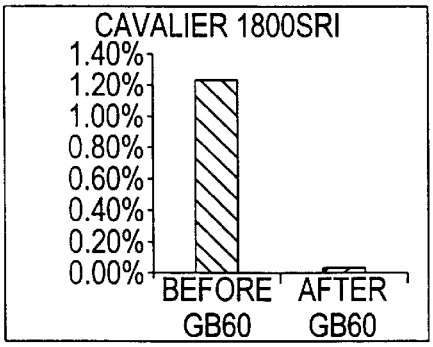
Figure 10:
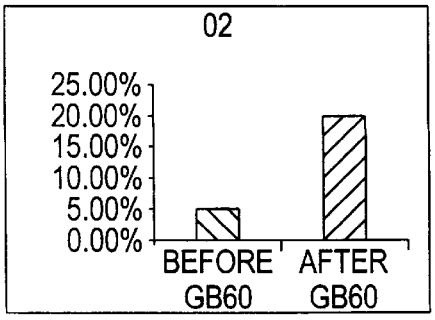
Figure 11:
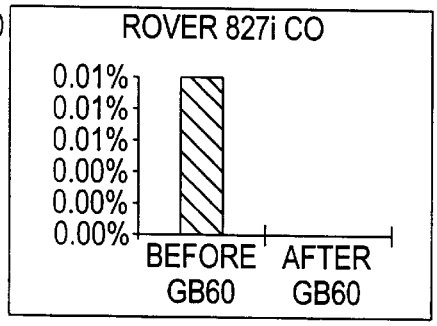
Figure 11:
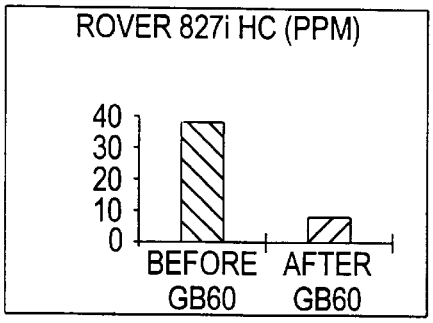
Figure 11:
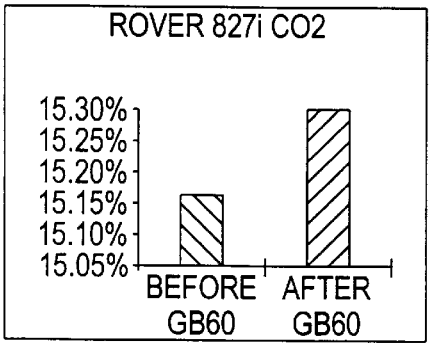
Figure 11:
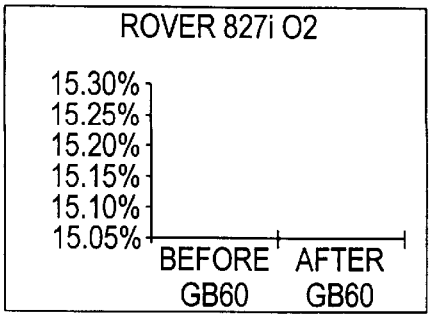

FIG. 10 shows that a Cavalier 1800SRI engine exhibited a 97.5% decrease in carbon dioxide emission as a fraction of total exhaust when fitted with an ignition system according to the invention, in comparison to prior art ignition circuits. FIG. 10 also shows that hydrocarbon emissions dropped by 93.8%, carbon monoxide emission dropped by 97.8%, and oxygen increased by 335.4%. A Rover 827i engine exhibited no carbon monoxide emission after being fitted with the an ignition system according to the invention, as shown in FIG. 11. In addition, the engine exhibited a 76.3% decrease in hydrocarbon emission and a 0.9% increase in carbon dioxide emission. No oxygen was exhausted under either operating condition.

Where catalysts cannot be fitted or actually manufactured for vehicles or engines, the use of the diode achieves typically up to a 90% reduction in the CO exhaust emissions and typically up to a 70% reduction in hydrocarbon emissions.

Figures will vary according to the pulse transformer or coil fitted and the fuel used and the type of carburettor installed in the normally aspirated engine.

Complete combustion of fuel has enormous benefits including the following:

Greater energy in the spark does help create improved combustion.

The improved combustion alters the burning bar pressure of the fuel.

The improved combustion and burning bar pressure increase the compression ratio per cylinder to near maximum i.e. 100% of original design of operating CR.

The increased compression and combustion reduce exhaust emissions and further improve the fuel economy.

Complete combustion improves the vehicle's responsiveness.

The total burn of hydrocarbons keeps the oil and filters clean for far longer than in a conventional engine environment.

The total burn of carbon monoxide and hydrocarbons in an engine maintains clean spark plugs, valve seats and exhaust systems.

A clean exhaust system helps to maintain a clean and more efficient Auto Catalytic Converter.

As the AFR is leaner at a high rpm and the operating temperature of the engine is kept to a minimum and due to the complete combustion of the carbon monoxide and hydrocarbons the NOx emissions are reduced.

Water content and (O) oxygen content of the exhaust emissions increase.

As the more complete combustion of the fuel occurs more power is generated even in the lean AFR high rpm environment and the $CO_2$ is slightly reduced or remains constant.

Improved combustion of the fuel within the dwell time also helps to eliminate hot spots within the combustion chamber.

The increased compression and burning bar pressure create greater MPG without having to alter the engine.

Results from independent test houses measuring the effects of the use of the Philips diode BY8424 on vehicles show that zero CO and hydrocarbon emissions are achievable on catalyst installed vehicles and are greatly reduced on normally aspirated vehicles. Both types of vehicle show lower $CO_2$ and NOx emissions, whereas the $H_2O$ and O or $O_2$ content of the emissions is increased.

We claim:

1. Spark ignition circuit comprising a source of high voltage;

a spark gap; and a diode connected between the voltage source and the spark gap, the diode having an inherent capacitance such that it acts as a capacitor when reverse biassed and being able to withstand a reverse breakdown voltage of 24,000 volts.

2. Spark ignition circuit as claimed in claim 1 in which the diode has a junction capacitance of 0.1–1 pF.

3. A spark ignition circuit as claimed in claim 1 in which the capacitance of the capacitor is no more than 1 pF.

4. A spark ignition circuit as claimed in claim 1 in which the diode has a reverse recovery time of the order of 200 ns.

5. A spark ignition circuit as claimed in claim 1 in which the diode is potted in a dielectric potting compound suitable for withstanding the high temperature in internal combustion engines.

6. A spark ignition circuit as claimed in claim 1 in which the diode can withstand forward voltages of the order of 24,000 volts.

7. A spark ignition circuit as claimed in claim 1 in which the diode can withstand forward and reverse voltages of between 24,000 and 90,000 volts.

8. Apparatus to be used in a spark ignition system, comprising:

a source of high voltage;

a spark gap;

a diode connected between the voltage source and the spark gap, the diode having an inherent capacitance such that the diode acts as a capacitor when reverse biassed;

potting compound conforming to standard EC 250 disposed about the diode to form a cylinder approximately 1.5 cm in diameter and 5 cm long; and terminals disposed at either end of the cylinder.

9. The apparatus of claim 8 wherein the terminals comprise a nickel chromium alloy.

* * * * *